United States Patent [19]

Ware

[11] 4,172,490

[45] Oct. 30, 1979

[54] CONSTANT TENSION BAND FOR CASTING MACHINE

[75] Inventor: Peter W. Ware, Carrollton, Ga.

[73] Assignee: Southwire Company, Carrollton, Ga.

[21] Appl. No.: 875,360

[22] Filed: Feb. 6, 1978

[51] Int. Cl.[2] ..... B22D 11/06

[52] U.S. Cl. ..... 164/433; 74/242.11 P

[58] Field of Search ..... 164/4, 87, 154, 431, 164/432, 433, 434; 74/242.11 P, 242.1 FP, 242.11 A, 242.8

[56] References Cited

U.S. PATENT DOCUMENTS

| | | | |
|---|---|---|---|
| 3,545,527 | 12/1970 | Bray et al. | 164/154 |
| 3,938,580 | 2/1976 | Donini | 164/433 X |
| 3,996,993 | 12/1976 | Bonnamour | 164/87 |
| 4,064,929 | 12/1977 | Quehen et al. | 164/433 |

*Primary Examiner*—Robert D. Baldwin
*Assistant Examiner*—J. Reed Batten, Jr.
*Attorney, Agent, or Firm*—Herbert M. Hanegan; Stanley L. Tate; Robert S. Linne

[57] ABSTRACT

In a continuous molten metal casting apparatus of the wheel-band type, wherein an elongated endless metal band partially closes a groove inscribed about the periphery of the rotatable casting wheel, an apparatus to apply and maintain a fixed, determinable tension to the elongated, endless band. The tension apparatus of the present invention permits the use of greatly elongated casting bands, maintaining a tension thereon, even during electrical power or air pressure supply failure, to thus provide improved band life. The tension wheel is rotatably mounted upon a carriage which slides on a pair of bellows-enclosed shafts, the carriage riding on a plurality of ball bushings. A dual-action air cylinder, attached at one end to the carriage and the other to the tension mechanism frame, operatively tensions the band through the wheel and carriage assembly. A spring loaded pawl attached to the carriage is restrained from engagement with a frame mounted rack during normal operation, which pawl engages the rack to constrain release of band tension should the air supply fail during operation. The apparatus is of a configuration such that it may be used or retrofitted with a great many of the various wheel-band casting machine configurations of past and present manufacture.

10 Claims, 10 Drawing Figures

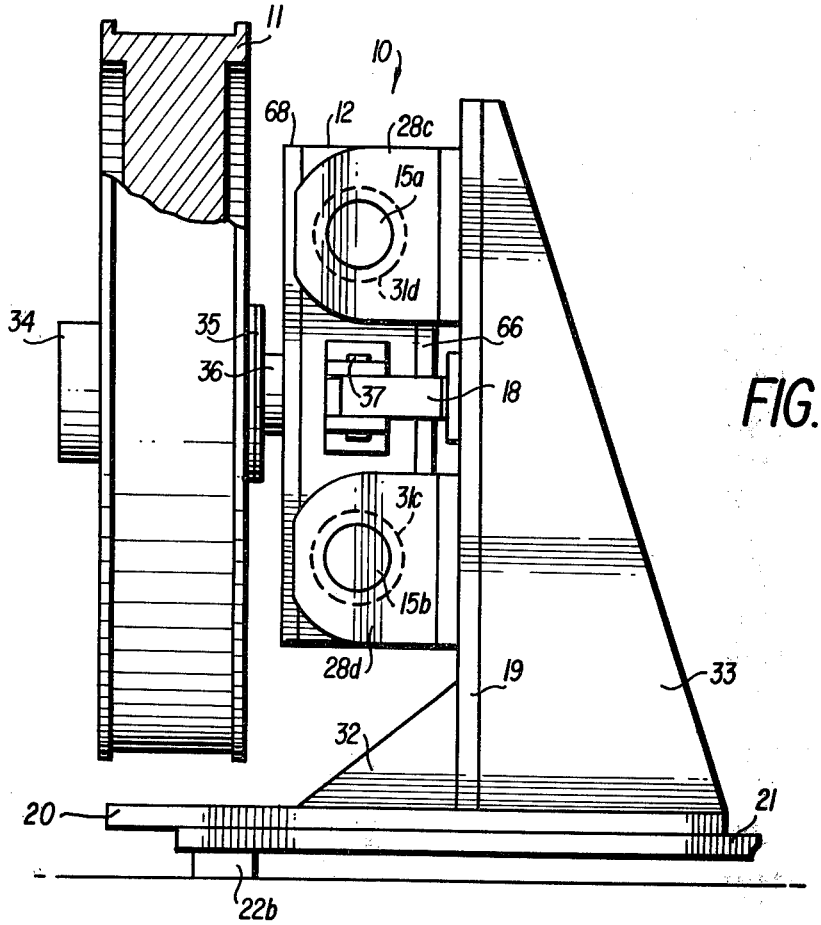
FIG. 2
FIG. 10
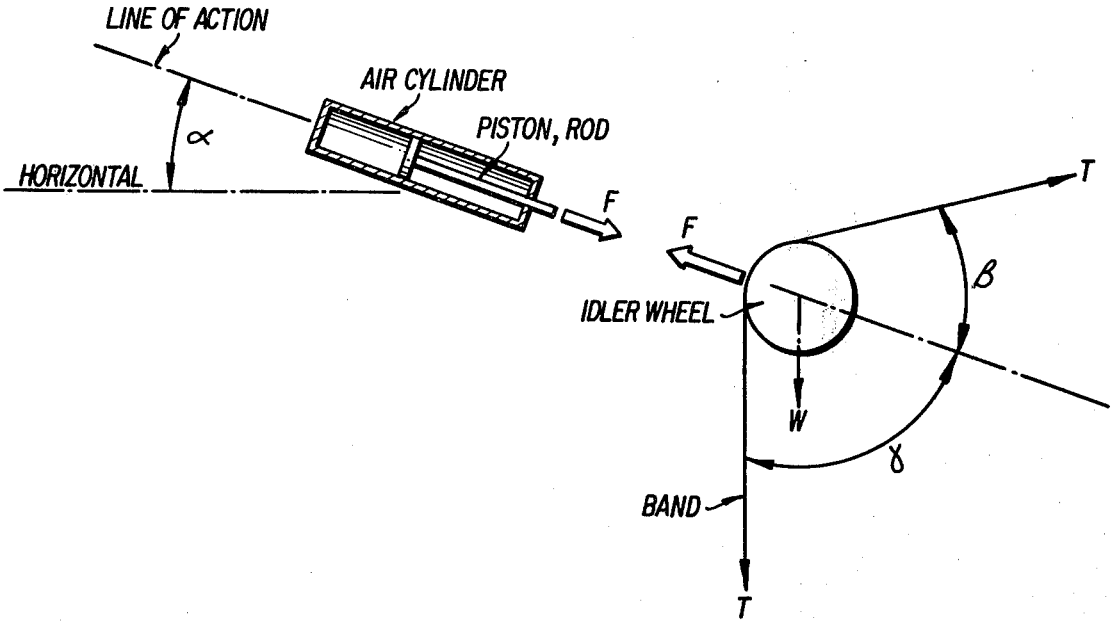

CONSTANT TENSION BAND FOR CASTING MACHINE

BACKGROUND OF THE INVENTION

In one typical system for continuously casting a molten substance, an endless flexible metal band is guided about one or more generally fixed position idler or tension band wheels and a portion of the peripheral groove of a casting wheel rotatable about a fixed axis. For the purpose of example but not limitation, the casting of molten metals such as copper, steel, and aluminum, or alloys thereof, will be discussed. The molten metal to be cast is poured in a continuous manner into the moving mold portion of the casting apparatus formed by the band and the peripheral groove in the casting wheel as the casting wheel is rotated by an external drive mechanism. Coolant is applied to the external and/or internal surfaces of the wheel and to the outside surface of that portion of the band which closes the peripheral groove of the casting wheel, said coolant acting functionally to extract the heat from the molten metal at a rapid rate and to prevent the casting wheel and band from overheating. At the time the metal band is removed from the peripheral groove of the casting wheel by the band guide wheels the previously molten metal is sufficiently solidified to permit extraction from the casting wheel and be guided on to a succeeding stage in the continuous casting process.

A key component in the operation of such wheel-band molten metal casting apparatus is the band. Indeed, economies created by the wheel-band machines in the past which have reduced the cost of the manufactured rod/strip/wire product while increasing product quality are largely attributable to the inherent continuousness of operation of such machines. Once wheel life is maximized well beyond band life, band life becomes a factor most limiting the continuousness of operation of the casting machine. Extending band life therefore functions to reduce operating down time, maintenance time, and operating and maintenance costs. Other systemic advantages accompany extended band life, including longer component lifetimes for thermally cycled system parts (pots, launders, pour spouts, casting wheels, furnaces, and burners), more energy efficient casting, greater overall productivity, reduced scrap product, longer life of subsequent mill rolls (due to fewer start-ups), and a better quality product.

In the operation of wheel-band continuous casting systems of the type generally described above, one of the major problems is the care, maintenance, and replacement of the band. Due to the need to form the band into arcs to pass around the casting wheel and band guide wheels, it must be made of flexible materials. Additionally, thinner bands permit more efficient transfer of heat from the molten metal than thick bands while having only two drawbacks; first, thin bands are more subject to band tensioning difficulties, and second, thin bands undergo more strenuous thermal cycling, compounding any tension difficulty tendencies. The two most common failure modes are due to thermal and mechanical stresses; both effects must be carefully considered when selecting materials for casting bands. Other factors to be considered include band cost, cost of preparation, ease of installation, band life, and heat extraction efficiency, the latter being of special import in the casting of alloys containing elements of differing solidification temperatures.

Generally, bands for this type of casting machine have been selected from among very low carbon steel alloys and copper and copper alloys when casting molten metals. One low carbon steel alloy in common use is A.I.S.I. 1006 or 1008 grade, having a good tensile strength (40,000 to 60,000 psi), low linear expansion, easily joined ends (TIG welding proves durable), is low in cost and is characterized by numerous other advantages when used for casting bands. Often, however, when bands of this material are improperly tensioned, they have been further characterized by short operating lifetimes, relatively low thermal efficiency, and a tendency to distort the draft angle of the casting wheel when under excess tension, thereby resulting in difficulty in extracting the cast bar and thus requiring early replacement of the quite expensive casting wheel.

Copper and certain alloys of copper have been tried as casting bands, with some successes noted. The primary advantages of such bands are substantially equal thermal expansion factors, improved thermal conductivity, and under certain tensioning arrangements, claimed longer band life.

U.S. Pat. No. 3,938,580 in part addresses itself to these latter factors. Indeed, a major advantage given in the cited specification is directed to the advantages obtained through the use of bands of such materials. While the embodiments of U.S. Pat. No. 3,938,580 are directed, in part, to the application of a controlled tension to an expansible (copper or copper alloy) band and consequently requires a significantly long slidable tensioning apparatus to suitably entrain the moving, expanding band, certain inherent limitations of copper and copper alloy bands reduce the effectiveness of the apparatus of said patent in producing a less costly or improved product.

It is known in the wheel-band type continuous casting art that certain copper alloy bands, under certain conditions, may appear to perform better than conventional low carbon steel alloy bands. These bands provide both improved thermal conductivity for extracting heat from the solidifying cast bar and thermal expansion ratios that are more equal to those of common casting wheels. However, bands made from these alloys are initially substantially more expensive than the normal low carbon steel bands; they are significantly more difficult to join into a continuous band in that special, expensive, and more critical welding procedures are required; and yet experience has shown that they frequently last no longer than perhaps twice as many hours as do steel bands. It should be noted that the band joining problem with copper or copper alloy bands is not only expensive, exacting, and difficult; but should the weld be less than perfect, and should the band separate suddenly due to a poor weld joint, operating personnel may be exposed to calamitous molten metal spills and resultant explosions. Such calamitous molten metal spills are all the more likely when using a copper or copper alloy band, as opposed to a low carbon steel band, because the weld joint, often one of the weakest points in the band, is exposed to mechanical stress from bending arcuately around the idler or casting wheel at nearly the same instant it is subjected to severe thermal shock from contact with the molten metal.

Listed as an advantage in the specification of the referenced patent, the linear expansion factor of copper and copper alloy bands also results in a cooling problem, though of less importance than that would be a calamitous molten metal spill. As the band stretches under the "constant" tension of the apparatus of U.S. Pat. No. 3,938,580, it becomes increasingly thin. Experience has shown that thinner bands dissipate extracted heat more rapidly with a given coolant flow. With no method or apparatus disclosed directed to continuous alteration of the volume of coolant flow directed to the band, more heat will be extracted sooner from the solidifying metal as the band becomes thinner; unless alterations in the coolant flow are made, changes in the crystalline structure of the cast bar may occur with long casting runs, with concomitant changes in the characteristics of the rod rolled therefrom. Further, so-called "ballooning" of the band may occur, wherein the band (as seen together with the wheel in cross section) withdraws diametrically outwards at its center from the molten metal in the casting wheel groove. Ballooning reduces the cooling ability of the band and at the same time increases the likelihood of a molten metal spill due to more limited contact of the band edges with the wheel. It is well known in the art that the probability of such ballooning increases as the band is thermally and mechanically cycled and stretched.

Copper and copper alloy casting machine band expansions are not entirely linear, as has been suggested in the prior art. Experience has shown that the expansion factor does for some time remain approximately linear, until reaching a certain determinable point, after which further uniform elongation is greatly diminished and after which time band failure due to overstretching becomes more likely with the progression of time. With copper or copper alloy bands the greatest share of band operating time occurs in this non-linear expansion portion of the band life time, during any portion of which the band may fail with little or no warning.

In order to determine the optimum tension applied to a given band length/material/casting machine combination, it is necessary to easily and accurately determine the tension applied to enable recording of the different tension information. An involved mathematical formula may be used to calculate this tension, as with the apparatus of U.S. Pat. No. 3,938,580, or a simple formula may be derived should the apparatus of the present invention be used. In the referenced patent, assuming all forces to be in a common vertical plane, it should be understood that as the angle of linear motion referenced to horizontal is changed (generally decreased in the referenced patent) and concomitantly the angle of one or more segments of the band with reference to the line of action of the retreating tensioning wheel decreases, the band tension forces change non-linearly. These and other factors introduce undue complexity in the determination of the band tension applied.

The general formula for determining the tension applied to a band is given as formula I; this formula is required in calculating the tension for tension means such as are presented in the embodiments of the cited patent.

The following symbols and definitions are used in formula I and associated FIG. 10:

Weight of band, which is small, is ignored.

P=Fluid pressure (Gauge)

A=Net piston area

F=Force exerted by cylinder

W=Weight of slide, wheel & other moving parts acting through the center of gravity.

T=Tension force in the band $\alpha$=Angle of linear motion to horizontal $\beta$=Angle of one segment of band with line of action $\delta$=Angle of 2nd segment of band with line of action Po=Fluid pressure at rest without band (pressure to overcome resultant of W)

Assuming that both sides of the piston and cylinder are at atmospheric pressure, neglecting friction and the weight of the band, and assuming that all forces are acting in a single plane:

FORMULA I $F=PA$, and:

$$F=T\cos\beta+T\cos\nu+W\sin\alpha;$$

$$T=(F-W\sin\beta)/(\cos\beta+\cos\nu), \text{ and:}$$

$$T=(PA-W\sin\alpha)/(\cos\beta+\cos\nu)$$

$$Fo=W\sin\alpha=PoA,$$

when substituted into the formula for T leaves:

$$T=(PA-PoA)/(\cos\beta+\cos\nu) \text{ or}$$

$$T=(A\ (P-Po)/(\cos\beta+\cos\nu)$$

For purposes of this computation, W sin $\alpha$ can be computed, even if the weight of the sliding portion, i.e., the carriage and wheel, etc., is not known, by following these steps:

1. Remove the band from the tension wheel.
2. Adjust the cylinder pressure until the force of the cylinder exactly balances the force of gravity on the sliding carriage. This is the point at which the sliding portion is between the end stops but motionless.
3. Record the pressure gauge indication of the air or fluid applied to the cylinder; this Figure is Po and may be substituted into the formula.

When the apparatus of the present invention is utilized the tension applied may be determined in accordance with the mathematically uncomplicated Formula II, thereby avoiding the necessity of mathematically sophisticated personnel in determining and recording the tension, and thereby minimizing personnel staffing problems and other difficulties in generating an adequate data base such as is required to determine optimum band tension for a variety of conditions.

FORMULA II

With $\alpha=0$; $\nu=0$ , and $\beta=0$, the prior art formula may be simplified as follows:

$$T=AP/2$$

The selection of given band materials is, lastly, dependent on many other factors than life and wheel-compatible linear expansion factors. While the use of copper or copper alloy wheels is well known in the wheel-band continuous casting of copper, aluminum, steel, and other metals, the preferability of a band material with the characteristics of copper or copper alloys may be limited to the casting of only one or two metals or a few metal alloys. The accumulated experience in the art indicates that, for example, low carbon steel alloys are most suited to the widest range of metals and metal alloys, and is thus a more universal band material than copper or copper alloy bands.

In the past most wheel-band continuous casting machines have been operated in more industrially developed areas having high reliability of electricity and fuel supplies. Those machines located in developing areas having less reliable electricity and fuel supplies have often suffered from down-time as well as personnel hazards created by the loss of band tension. Also, electrical power outages are frequently caused by lightning overloads. As power outages and fuel interruptions around the world may become more frequent, it becomes economically advantageous to find fail-safe power substitution mechanisms and substitute power/fuel supplies which may be used during such outages. Accordingly, the present invention incorporates into the constant band tension apparatus a fail-safe tension maintenance mechanism which is not directly dependent on electrical power and is immediately actuated to maintain band tension should the air supply pressure, which is usually electrically generated and maintained, fall below predetermined levels.

It is therefore obvious that there is a need in this art for certain improvements in operating economy such as may be obtained with greater operating lifetimes from inexpensive bands and, with increasing costs in the manufacture of metal casting machinery, reduced casting machine operating expense. Furthermore, a need exists for an improved, simplified band tensioning apparatus intended for use with elongated bands, especially a band tensioning apparatus which might at low cost be retrofitted to many prior art or previously manufactured casting machines.

SUMMARY OF THE INVENTION

Briefly described, the present invention comprises a casting machine generally known in the metal casting art as being of the wheel-band type, with which a normal or greatly extended length band of ordinary low carbon steel may be maintained at a fixed, determinable tension against the casting wheel, without regard to minor eccentricities of the casting or idler wheels. The apparatus of the present invention is further directed to facilitate the experimental determination of the optimum tension to be applied to ordinary material casting bands of varying width, thickness, composition, or other properties.

Thus it is an object of this invention to provide a casting machine of the wheel-band type for the continuous casting of molten metal or other substances, which casting machine includes a band, band tensioning arrangement, and a band-wheel arrangement that permits the maintenance of the optimum tension for any given band or band material and wheel combination.

Still another object of this invention is the provision of a combination of apparatus elements enabling simple, rapid and accurate determination of band tension during machine operation, which collected tension records may be used as a data base in determining optimum band tension.

Yet another object of this invention is the reduction of casting machine downtime for replacement of a band or of a wheel by optimizing the band tension and therefore band life.

Still another object of this invention is the elimination, through the use of a fail-safe mechanism, of certain hazardous machine operation situations in the event of the loss of electrical power or air pressure supplied to the tensioning apparatus, or caused by eccentricities in the casting or idler wheels.

Another object of this invention is the elimination of hazardous machine operation situations which occasionally arise from poor band/wheel sealing with out-of-round casting wheels, accomplished by the inherent accommodation of the constantly tensioned band to sealingly engage such out-of-round casting wheels, thereby preventing molten metal spills or splashes, and explosions caused thereby.

Still another object of this invention is the provision of a fail-safe band tensioning mechanism which enables ready change or adjustment of the band tension by merely changing the air or fluid pressure applied.

Yet another object of this invention is the provision of tensioning means operable such that once set for a specific tension, that selected tension may be maintained within close tolerances even after band or wheel replacement without additional adjustment.

With these and other objects in view which may become hereinafter apparent, the nature of the invention may be more clearly understood by reference to the several views illustrated in the accompanying drawings, the following detailed descriptions thereof, and the appended claims.

BRIEF DESCRIPTION OF THE DRAWINGS

Numerous other features and advantages of the invention disclosed herein will be apparent upon examination of the several drawing figures forming a part hereof, and in which like reference characters indicate corresponding parts in all views:

FIG. 2 is a partial end view of the apparatus of this invention wherein the wheel means may be seen as offset from the frame means, and between which is shown the sliding mechanism by which the wheel means may be advanced or retracted in relation to the fixed frame means in order to release or tension the band of a wheel-band molten metal casting apparatus, and in which figure the fail-safe tension locking device may be partially seen.

FIG. 10 illustrates diagramically the forces involved in the derivation of formula I.

DESCRIPTION OF THE PREFERRED EMBODIMENTS

Figure 1:
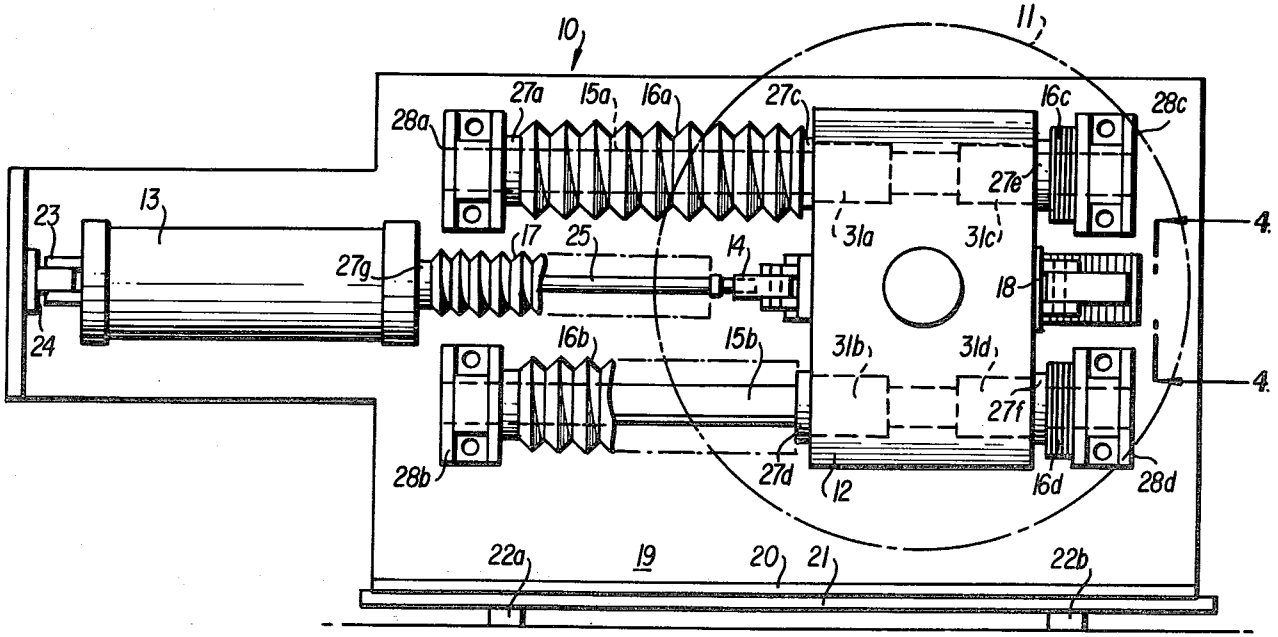
FIG. 1 is an elevation view of an apparatus for tensioning the band of a wheel-band type continuous casting machine in which said band arcuately engages the wheel means of said tensioning apparatus about a portion of its periphery.

Referring now in greater detail to the drawings, FIG. 1 shows the main apparatus of the present invention, generally referred to by the numeral 10, and in which are shown the relationship of the major components, including the tension wheel 11; sliding wheel carriage 12; cylinder 13; cylinder rod eye 14; slide shafts 15*a* and 15*b*; protective bellows 16*a*, 16*b*, 16*c*, 16*d* and rod protective bellows 17; tension safety securing mechanism 18; mounting plate 19; base plate 20; sub-base plate 21; mounting pads 22*a* and 22*b*; pivot pin 23, eye bracket 24; cylinder rod 25; bellows clamps 27*a*, 27*c*, 27*d*, 27*e*, 27*f* and 27*g*; slide shaft pillow block 28*a*, 28*b*, 28*c*, and 28*d*; and ball bushings 31*a*, 31*b*, 31*c*, and 31*d*.

Certain portions of the apparatus shown in FIG. 1 are normally hidden from view or less obvious when normally viewed; therefore, these certain portions are shown in outline, hidden line, or alternate position view. Included in these categories are the tensioning wheel 11, shown in outline form to reveal components lying behind said wheel; the ball bushings 31*a*, 31*b*, 31*c*, 31*d*, contained within the sliding wheel carriage 12; and the coupling means connecting the cylinder rod eye 14 to the sliding wheel carriage.

Still referring to FIG. 1, the tensioning wheel 11 is operatively urged into contact with the casting machine band by force of a constant, regulated air or hydraulic pressure applied to cylinder 13; the cylinder rod 25 is therefore pushed or pulled (depending on the cylinder type) in engagement with the sliding wheel carriage 12 to which the cylinder rod eye 14 is coupled through a typical clevis bracket and pivot pin. The carriage 12 travels back and forth freely on slide shafts 15*a*, 15*b* responsive to the pressure applied to cylinder 13, said carriage riding on a plurality of ball bushings 31*a*, 31*b*, 31*c*, and 31*d* which circle in close engagement shafts 15*a* and 15*b*. To protect the shafts 15*a*, 15*b* and bearings 31*a*, 31*b*, 31*c* and 31*d* from the harsh and unclean atmosphere typical in areas where molten metal casting apparatus are located, bellows pairs are provided for each shaft. In the illustrated embodiment, bellows 16*a* and 16*c* function as a pair to protect shaft 15*a*, while bellows 16*b* and 16*d* protect shaft 15*b*. Air passageways are provided (through the carriage) between each bellows in a bellows pair to provide for the mutual exchange of air through the carriage 12 when the wheel 11, rotatably affixed to the carriage, is moved back and forth during normal operation. Another bellows 17 protects the cylinder rod from the same harsh atmosphere. Pillow blocks 28*a*, 28*b*, 28*c*, and 28*d* maintain the slide shafts 15*a*, 15*b* in fixed contact relationship to the mounting plate 19. In the preferred embodiment of this invention the constant tension apparatus frame is comprised of mounting plate 19, base plate 20, sub-base plate 21, mounting pads 22*a* and 22*b*, and reinforcing plates 32 and 33, all of which are best seen in FIG. 2.

Also shown in FIG. 2 are the constant tension apparatus 10; tension wheel 11; sliding wheel carriage 12; slide shafts 15*a*, 15*b*; tension safety securing mechanism 18; mounting plate 19; base plate 20; sub base plate 21; mounting pad 22*b*; slide shaft pillow blocks 28*c*, 28*d*; outer flange 34; inner flange 35; axle 36; and pivot pin 37. Shown in hidden line form are ball bushings 31*c* and 31*d*.

Wheel 11 is rotatably attached to the sliding wheel carriage 12 via axle 36, which is threaded at the wheel end to receive the outer flange 34, which flange securely presses the hub of wheel 11 against inner flange 35. Axle 36 is necked down to accept the tension wheel 11 hub and inner flange 35, but is of a greater diameter closer to the sliding wheel carriage 12 to hold the inner flange 35 and thus the tension wheel 11 in a fixed distance relationship from the sliding wheel carriage 12.

Figure 4:
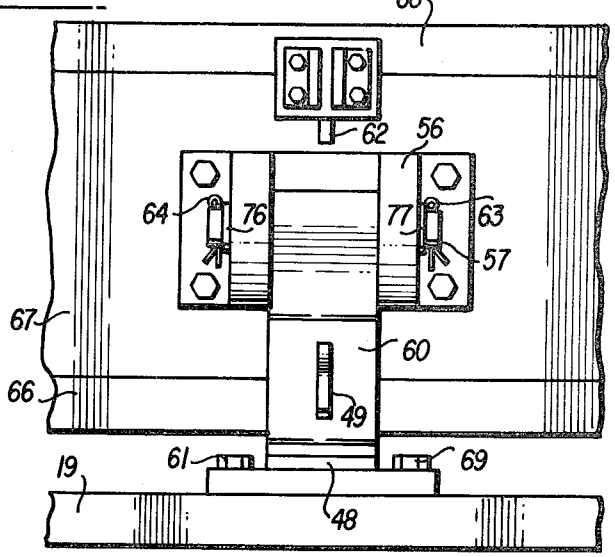
FIG. 4 is a partial end view of the apparatus of this invention taken along line 4—4 of FIG. 1, and in which further details of the locking pawl are shown with their relation to the slide means portion of the tensioning device.
Figure 3:
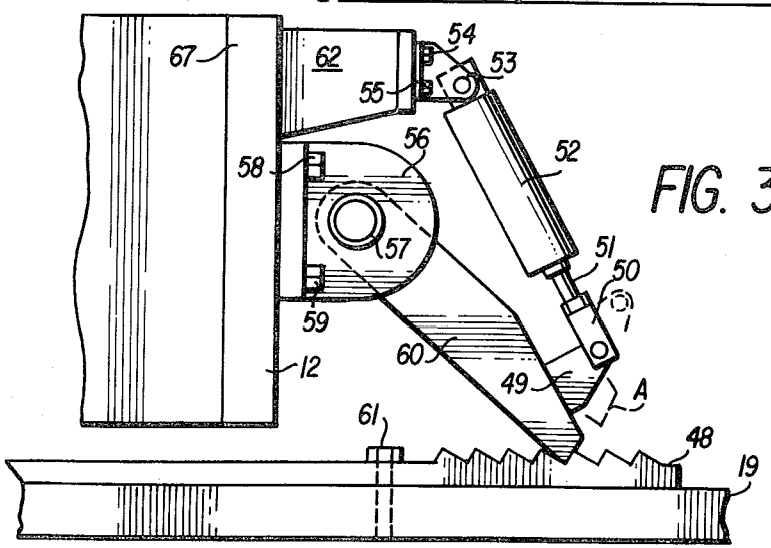
FIG. 3 is a partial plan view of the fail-safe tension locking mechanism in this invention, and in which the apparatus is depicted in its locked, fixed tension position. The normal operational position of the locking pawl is also indicated.

Details of the innovative tension locking mechanism are shown in FIGS. 3 and 4. Referring first to FIG. 3, the front edge or end plate 67 of the sliding wheel carriage 12 supports carriage main clevis 56, which is attached with threaded fasteners 58 and 59; immediately above main clevis 56 the carriage upper clevis bracket 62 is affixed to the carriage end plate 67, for illustrative purposes but not limitation, through welding. Through the eye of main clevis 56 is a relatively large pawl pin 57 which holds pawl 60 rotatably attached to sliding wheel carriage 12. Two cotter keys (63, 64 of FIG. 4) or other fasteners secure pawl pin 57 within the clevis. The tip of pawl 60 in the normal operation condition is extended away from the rack 48 to a position indicated at A by hydraulic or pneumatic cylinder 52, which pulls in cylinder rod 51, threaded into which is rod clevis 50. Clevis 50 is pinned through clevis bracket 49, attached to pawl 60. The hydraulic or pneumatic cylinder 52 is attached to the sliding wheel carriage 12 through the use of a plurality of threaded or other fasteners 54, 55 which are attached to carriage upper clevis bracket 62 and secure clevis bracket 53.

Cylinder 52 is spring loaded to force pawl 60 to return to and engage lock rack 48 in the event of failure or removal of the air or hydraulic pressure retracting cylinder 52. In this condition the band tension cannot be reduced or increased because pawl 60 is engaged in lock rack 48; however, in an alternate embodiment of this invention, means may be provided to manually increase or reduce band tension slightly without departing from the scope and spirit of this invention.

Referring now to FIG. 4, depicted are portions of the fail-safe tension locking and band tension wheel carriage mechanisms. Lock rack 48 is mounted on mounting plate 19 and secured with threaded fasteners 61 and 69. In locking engagement with lock rack 48 is pawl 60 on which is mounted rod clevis bracket 49. The attachment of pawl 60 to sliding wheel carriage 12 is shown most clearly in this view; however, certain related items are omitted for clarity, including cylinder 52 and associated components and clevis fasteners 54 and 55. Pawl pin 57 is inserted through carriage main clevis 56 to secure pawl 60. Pawl pin 57 is in turn secured in place and prevented from unintentional withdrawal by cotter keys 63 and 64 or the like; washers 76 and 77 permit greater rotational freedom of pawl pin 57 and serve to isolate cotter keys 63 and 64 from carriage main clevis 56. Carriage upper clevis bracket 62 is weldably attached to carriage end plate 67 which is turn is attached to carriage rear plate 66 and carriage front plate 68.

It is to be noted that construction and operation of the band tension mechanism is in all respects similar in succeeding FIGS. 5 through 9, which are included to more particularly demonstrate and display the flexibility of the present invention in retrofitting said invention to a multiplicity of wheel-band casting machine designs.

Figure 6:
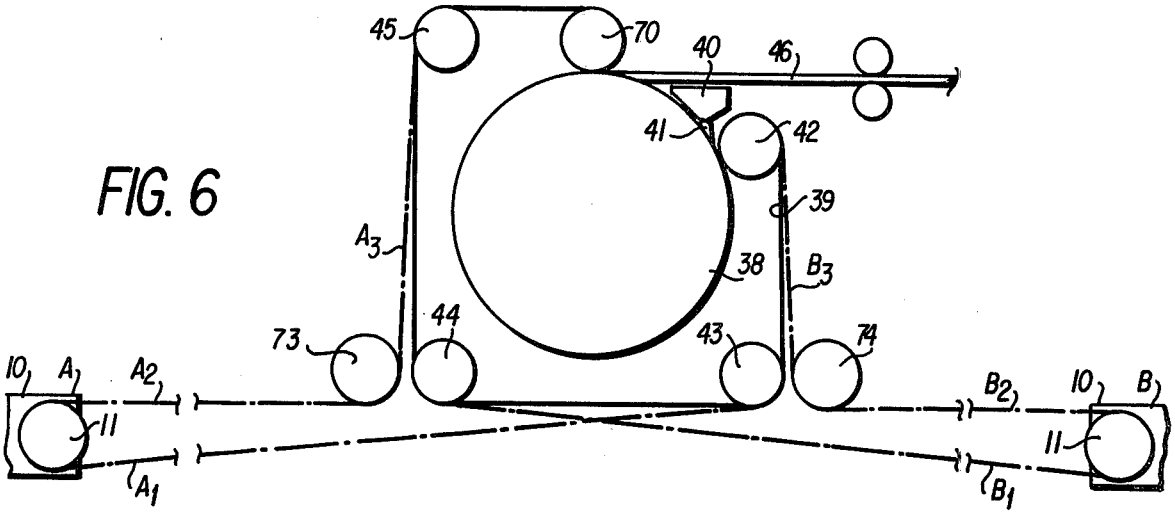
FIG. 6 is a partial side elevation view of another continuous wheel-band type of casting machine to which, by the addition of an idler wheel in either of two locations, the apparatus of the present invention may be fitted advantageously. Shown in dotted line form are the alternate band routes; break symbols indicate that indefinite length bands may be used, thereby permitting the use of suitably elongated bands.

Now referring to FIG. 6, a typical wheel-band type continuous casting machine is shown including the major components casting wheel 38; band 39; pour pot 40; pour spout 41; band presser/idler wheel 42; idler wheels 43, 44, and 45; cast bar 46; and extraction conveyor 47. Also shown at A, B, and C are alternate locations for the constant band tension apparatus 10 of this invention (shown in outline form).

At A, the tensioning apparatus 10 is located in line with the normal band travel but removed an appropriate distance from the casting wheel to enable the use of an extended length band. The longer band alternate routing is indicated at A1, A2, and A3.

Beginning at the point where the band 39 is pressed against the casting wheel 38 by the band presser/idler wheel 42 to form the mold entrance, the remainder of the mold is formed by band 39 and casting wheel 38. Molten metal (not shown) is introduced into the mold entrance through pour spout 41 from a pour pot 40 or similar means. As the wheel and band rotate in engagement, coolant (not shown) is applied to the wheel and the band to extract heat from the rapidly solidifying molten metal. As the cast bar 46 exits the mold, it is deflected along a path determined by the configuration of the extraction conveyor 47. The band, separated from contact with the bar 46 and the casting wheel 38, travels arcuately over idler wheel 45 and along path A3 to the opposite (of normal operation) side of idler wheel 44 and extends to the constant tension apparatus 10 at point A along path A2 for a distance determined by the overall length of the band 39. The band approaches the tension wheel of constant tension apparatus 10 substantially parallel to its exit along path A1. The tension wheel diameter and location may be selected to maintain the substantial parallelness of the band along paths A2 and A1, though normally tension wheel diameters smaller than that of idler wheel 44 are avoided to minimize undue flexing of the band 39. Following path A1 the band travels to and arcuately around idler wheel 43 from which point it follows its normal path to and arcuately around idler/band presser wheel 42. A plurality of small rollers 75*a*, 75*b*, 75*c*, etc., may be placed along and immediately below path A1 to reduce the catenary formed by band 39 during non-tensioned periods. The provision of such rollers, which perform no function during normal, tensioned operation, do however reduce the tension which must be applied to the band 39 during band exchanges and thereby reduce the amount of travel required by the tensioning apparatus. Also, where a single catenary might permit the band to come into contact with the floor of the casting or band pits and thereby introduce scratches or other band 39 surface imperfections which could contribute to premature band failure, the provision of such rollers generally help preclude such problems.

Figure 5:
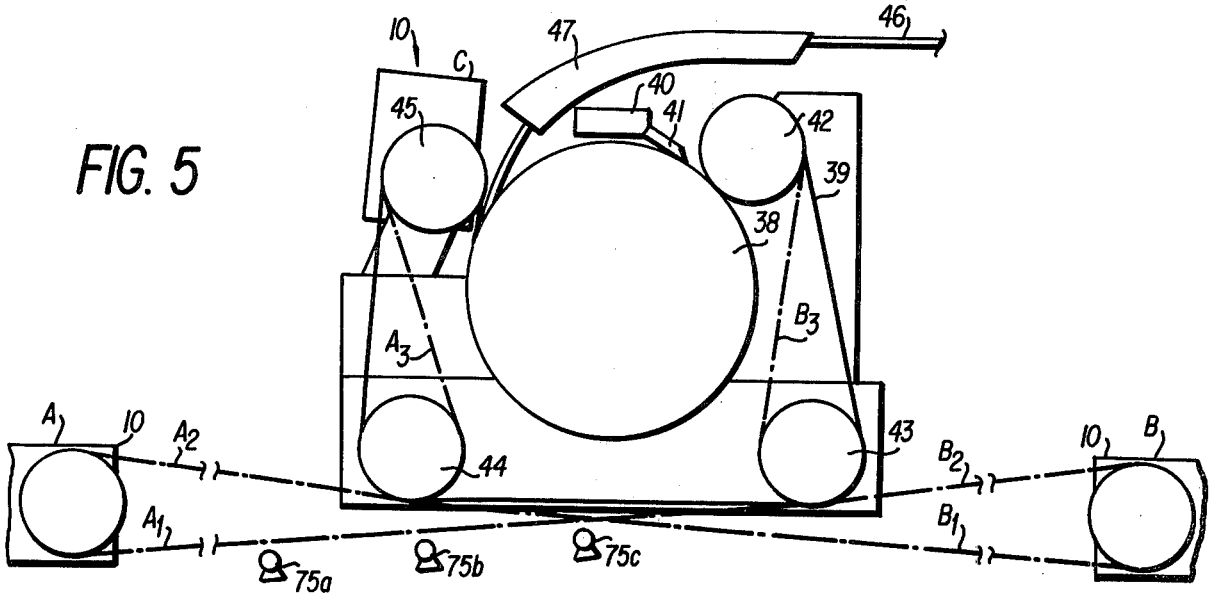
FIG. 5 is a partial side elevation view showing alternate locations for use of the tensioning apparatus of this invention and alternate band routing positions therefor with a common casting machine general configuration. The wrap angles around tension wheel A or alternately tension wheel B in actuality are closer to 180° than shown, this difference being due to space limitations of the drawing. At location C, the tensioner is operated vertically to apply tension to the band, said band being otherwise routed in the normal manner.

A second alternate location for the constant tension band apparatus 10 is illustrated in FIG. 5 at point B. When the apparatus is located in this position, provision must generally be made to support whatever apparatus may be located after the extraction conveyor and which would often be directly above the extended band. An adequately reinforced tunnel would be suitable to accommodate the weight of such succeeding apparatus. Following the band 39 through a cylce, beginning with its exit from idler wheel 44 in FIG. 5, the band 39 follows path B1 to and arcuately around the tension wheel of constant tension apparatus 10 located at B. Between idler wheel 44 and a tension apparatus located at position B, one or more smaller rollers (not shown) may be utilized to reduce the catenary as previously described. After passing around the tension wheel of tensioning apparatus 10, the band 39 follows path B2 to and arcuately around idler wheel 43, then follows path B3 to and arcuately around idler/presser wheel 42. The band 39 then follows its normal operating path through a casting cycle.

Still a third alternate location for apparatus 10 of the present invention is at the location generally indicated at position C in FIG. 5. Here, unless located at a considerable distance above the casting machine, little or no advantage in casting band 39 length can be obtained. The generally very desirable objective of maintaining a constant tension of measurable magnitude on the casting band 39 can, however, be achieved in this configuration. In this case, the tension apparatus 10 is operated without the band in place to determine the air pressure needed to lift the sliding wheel carriage 12 (FIG. 2) and tension wheel 11 (FIG. 2) to a fixed, steady state position; this figure is later subtracted from the pressure required to maintain the desired constant tension on the band 39 when calculating such tension.

In all three of the preceding examples operation of the constant tension apparatus may be utilized to improve band life with little or no modification to existing casting machines; further examples will be illustrated.

In FIG. 6, retrofitting the constant tension mechanism 10 of the present invention requires an additional idler wheel 73 or 74 mounted adjacent to either of the two bottom idler wheels 43 and 44 (or relocating wheels 43 or 44 to either one of the adjacent positions shown respectively) to prevent the rerouted, moving band 39 from brushing the oppositely moving portion of the band arcuately engaging the casting wheel; such brushing action would place undue stresses on the band and result in early band failure. As in previous examples, when constant tension mechanism 10 is located at either position A or B, drawing space limitations prevent showing the full extent of the band extension. Broken line indicators are thus used to show the lengthened band 39 and the band wrap angles around the wheel 11 of the constant tension mechanism 10 are slightly exaggerated. In reality, the band wrap angles more closely approach 180°, the desired wrap angle.

Beginning with embodiment A of FIG. 6, the casting band 39 disengages casting wheel 38 and the cast bar 46 and travels arcuately around exit idler wheel 70, thence follows path A3 to idler wheel 45 and down to and partially around additional idler wheel 73 and continues on path A2 toward and arcuately around the wheel 11 of constant tension mechanism 10 located at position A. Exiting the tension wheel, band 39 follows path A1 to idler wheel 43 and then continues in the normal manner around idler wheel 42 and casting wheel 38, forming a moving casting mold into which molten metal is poured through pour spout 41 from pour pot 40.

An alternate retrofit arrangement for use of the constant band tension mechanism 10 with casting machines of the general configuration shown in FIG. 6 is with the constant tension apparatus 10 located at position B. Beginning at the disjuncture of casting wheel 38, cast bar 46, and casting band 39, the band travels arcuately around exit idler wheel 70 to idler wheel 45 and down to and around idler wheel 44, from which point the band 39 departs its normal position and follows path B1 to and around the tension wheel 11 of constant tension mechanism 10 located at position B. Small idler wheels (not shown) may be located along and just below path B1 to assist in supporting the band by providing multiple, shorter catenaries when the band 39 is loosened, as for casting wheel 38 or casting band 39 changing operations. After passing approximately 180° around the tension wheel 11 the band 39 continues along path B2 to and partially around additional idler wheel 74, then follows path B3 to and around idler wheel 42, at which time a new casting cycle is commenced.

Figure 7:
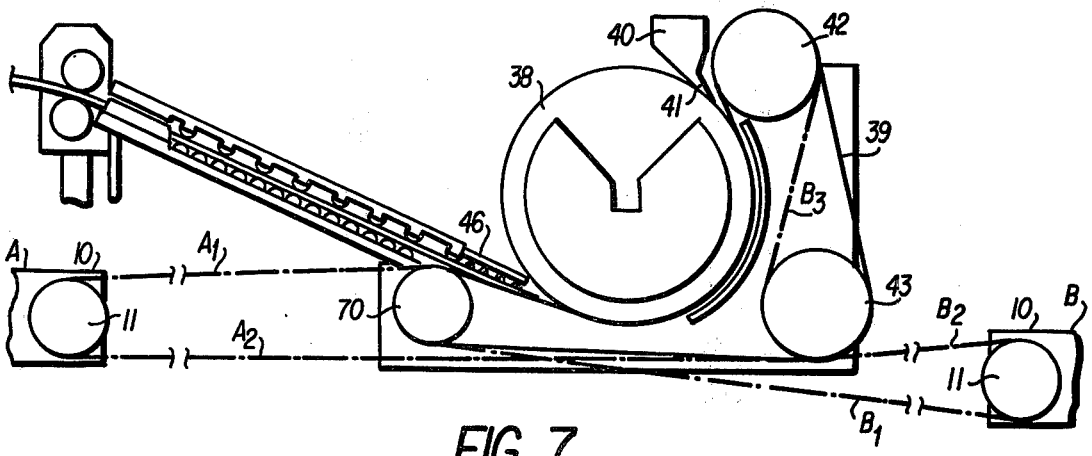
FIG. 7 is a partial side elevation view of another continuous wheel-band type of casting machine to which the apparatus of this invention may be advantageously fitted. Shown in dotted line form are two of many alternate band routings possible with the present invention; break symbols indicate that indefinite length bands may be used, thereby permitting the use of long bands.

FIG. 7 shows yet another wheel-band casting machine configuration with which this invention may be used. Again, two alternate locations are disclosed for installation of the tension control apparatus 10. The casting machine shown in this configuration is intended for high speed production with a mold length of slightly less than 180° of casting wheel rotation. The cast bar exits the machine in an incompletely solidified state and is subjected to an intensive liquid coolant spray to complete the solidification process. When the constant tension apparatus 10 is located at position A, the band 39 is simply extended past exit idler wheel 70 along path A1 until reaching the tension wheel 11, around which the band 39 passes for a 180° wrap angle, after which it passes along path A2 to and partially around idler wheel 43 to continue in the normal operating manner.

Along and immediately below path A2 may be located one or more small rollers to reduce the catenary formed by the band during tension released conditions, as occur for example during wheel or band changes.

In the B position, band 39 leaves exit idler wheel 70 and follows path B1 to and approximately 180° around tension wheel 11 portion of constant tension apparatus 10. Again, catenary reducing rollers may be advantageously located beneath the band. Completing its pass around tension wheel 11, the band 39 follows path B2 to and partially around idler wheel 43 before continuing along path B3 to band pressure-idler wheel 42, after which the band 39 continues in its normal manner through a casting cycle.

Figure 8:
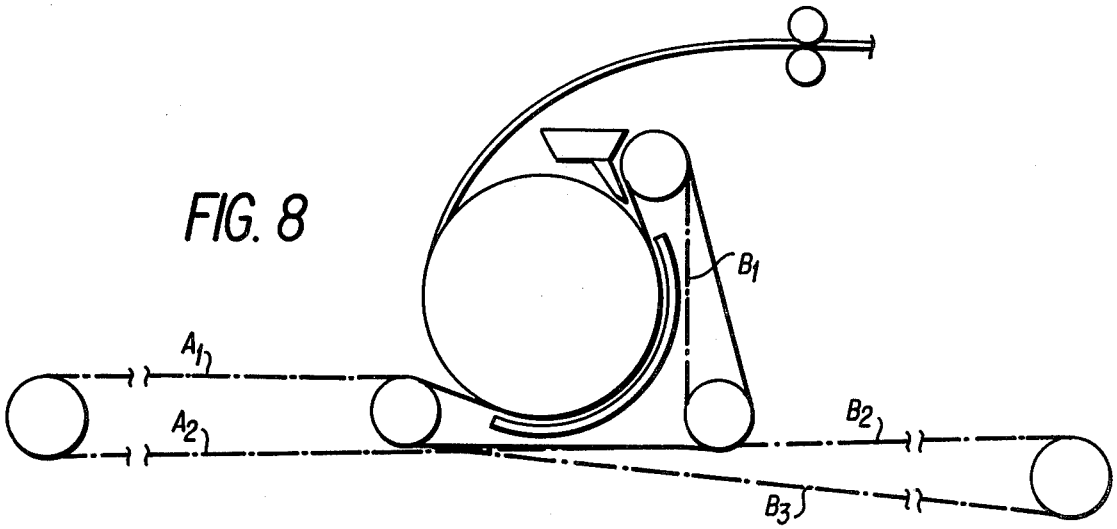
FIG. 8 is a partial side elevation view of still another continuous wheel-band type of casting machine with which the apparatus of this invention may be utilized. Shown in dotted line form are two alternate band routings possible with this invention, break lines indicate that extra long bands may be used in either arrangement.

The continuous casting machine of FIG. 8 may be retrofit with the present invention in the same manner as previously described for the continuous casting machine of FIG. 7, to which it is identical except for the bar exit point and the fact that the bar is massively cooled in the casting wheel groove rather than on a separate bar conveyor.

Figure 9:
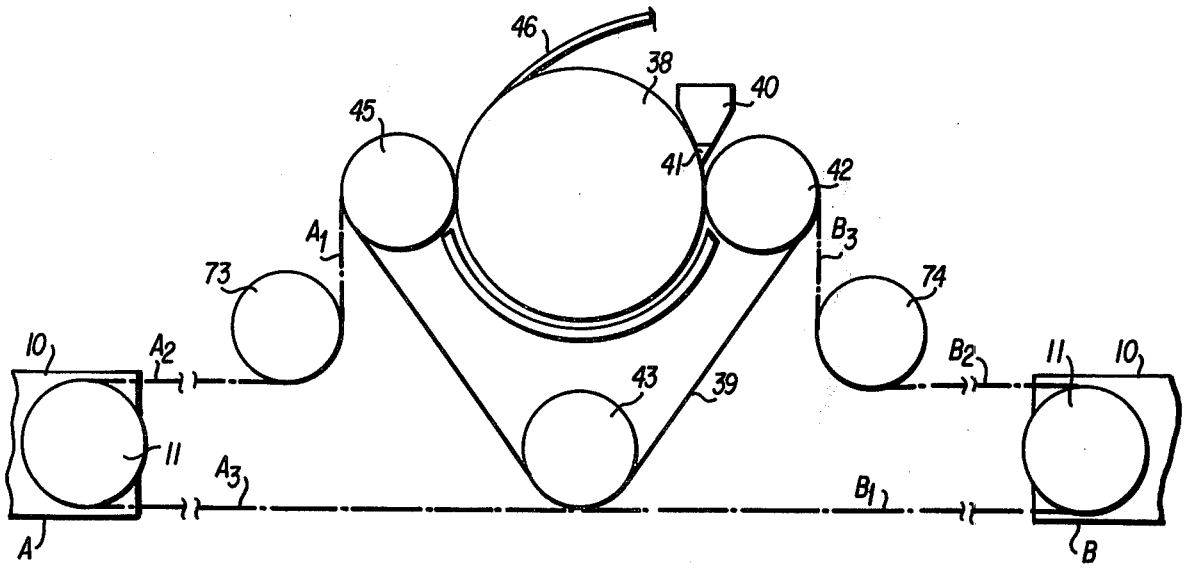
FIG. 9 illustrates in partial side elevation view another continuous wheel-band type of casting machine with which this apparatus may be used. Two locations for the tensioning apparatus and associated band routings are indicated; break lines indicate that extra length bands may be used.

Many continuous casting machines have been manufactured in arrangements similar to that depicted in FIG. 9; the apparatus of the present invention may be usefully included with such a casting machine and may be located at either position A or position B. In the case of a retrofit addition of a constant tension apparatus 10 such as disclosed in this invention to a casting machine of the arrangement depicted in FIG. 9, original idler wheel 43 (which may in the original design function also as a tension wheel) is retained to maintain the band path away from the casting wheel 38. One or more fixed position idler wheels may be required for the use of the present invention.

In the operation of such a casting machine including a long band, constant band tension apparatus 10 located at position A, the band 39 is separated from the casting wheel 38 by passing arcuately around exit wheel 45. However, the band 39 passes next along path A1 to and partially around added idler wheel 73, thence via path A2 to and 180° around tension wheel 11 portion of constant tension apparatus 10. Band 39 next travels along path A3 to and partially around idler wheel 43 and returns to its original path. When the constant tension mechanism 10 is located at position B, a similar, mirror image path is followed by band 39 disengaging the casting wheel 38 and the cast bar 46 by traveling arcuately around exit wheel 45. The band is routed along its normal path to and around idler wheel 43, from whence it follows alternate path B1 to and 180° around tension means 11 of constant band tension mechanism 10. Path B2 is then followed by band 39 between the tension wheel 11 and added idler wheel 74, following which the band travels along path B3 to and around band presser/idler wheel 42 before beginning its normal path for a casting cycle.

While the invention has been specifically illustrated and described herein with reference to preferred embodiments thereof, it is contemplated that minor modifications could be made without departing from the spirit of the invention.

What is claimed is:

1. A device for tensioning the casting band of a wheel-band continuous molten metal casting machine which comprises:

a. a band tensioning wheel adjacent said casting machine about which may be engaged the casting band to be tensioned; said engagement being equal to about 180° wrap angle about the band tensioning wheel;

b. an axle shaft to which the tensioning wheel is rotatably affixed;

c. a sliding carriage having a face to which said axle shaft is perpendicularly attached;

d. a plurality of parallel slide shafts upon which the sliding carriage may freely travel for a limited range;

e. a fluid cylinder means having an output shaft pivotably attached to said sliding carriage, and containing therein a piston attached to said output shaft, said piston being responsive to the fluid pressure for applying a force to the sliding carriage in a direction substantially parallel to the slide shafts;

f. a main mounting plate on which the plurality of slide shafts are fixedly mounted at each of their respective ends;

g. a clevis means suitably attached to said main mounting plate, one end of said fluid cylinder being pivotably attached within said clevis means; and h. at least one base mounting plate means by which the main mounting plate may be secured to a fixed position suitable for tensioning said casting band.

2. The apparatus of claim 1 and further including a positive stop, fail-safe tension locking means which comprises:

a. a pawl means pivotably attached to the end of the sliding wheel carriage;

b. a triangularly notched rack means to engage said pawl, said rack means arranged along the center line of said sliding carriage and fixedly attached to said main mounting plate parallel to the direction of movement of said sliding carriage;

c. a first bifurcated clevis means attached to the sliding carriage at a point extending therefrom along the center line thereof such that the channel of the clevis is perpendicular to the centerline of said rack and parallel thereto;

d. a retracting, spring-return-to-normal position fluid pressure operated cylinder means having at one end a flat, drilled trunnion appurtenance which is pivotably pinned within the channel of the first clevis means, and adapted to being connected to a fluid pressure source;

e. a second bifurcated clevis means attached to the sliding carriage along the centerline thereof and extending therefrom a lesser degree than said first bifurcated clevis, said second clevis means being mounted parallel to and between said first clevis means and said rack means attached to the main mounting plate;

f. pin means by which said pawl is pivotably secured to the second clevis means, said pawl being thereby positioned such that engagement of the pawl in the triangular grooves of the rack may be readily attained.

3. The apparatus of claim 1 further comprising:

a. an expansible-collapsible bellows means fixedly attached at the rod end of the carriage operating fluid cylinder means, the opposite end being attached to said rod near its exposed end such that the portion of the fluid cylinder rod otherwise exposed is covered and protected by the bellows;

b. a plurality of expansible-collapsible bellows pairs, wherein one end of each bellows in a bellows pair is fixedly attached to opposite sides of the said sliding carriage in such a manner so as to encircle an individual sliding carriage shaft, and in which the opposite end of each bellows in a bellows pair is attached to the complementary ends of said carriage shaft;

c. said sliding carriage being provided with an air passage means to communicate between each bellows of a given bellows pair, thereby affording rapid and unrestricted equalization of the air pressure within each bellows in a bellows pair upon movement of the carriage.

4. The band tensioning apparatus of claim 3 positioned adjacent a wheel band casting machine having a mold formed by a rotatable casting wheel about the periphery of which is inscribed a groove and by an elongated, endless band which engages the periphery of said casting wheel, a plurality of band guide wheels rotatably mounted at fixed locations adjacent the periphery of and substantially within the plane of said casting wheel to remove said band from the surface of said casting wheel at the desired end of the mold cavity and to redirect said elongated band at one point towards the aforementioned band tensioning means, from which point the band is again directed to and around one or more of the band guide wheels.

5. The apparatus of claim 4 in which a band of substantially greater length than its normal length counterpart is substituted therefor and wherein said tension apparatus moves horizontally to tension or untension said band.

6. The apparatus of claim 5 in which a plurality of rotatably mounted band support wheels located in the plane of the casting wheel and substantially along the path of and below the extended length band are provided to support the band when it is released to its untensioned state.

7. The apparatus of claim 3 in combination with a wheel-band molten metal casting machine having a mold formed by a rotatable circular casting wheel about the periphery of which is inscribed a groove and by an endless band which engages the periphery of said casting wheel, a plurality of band guide wheels rotatably mounted at fixed locations adjacent the periphery of and substantially within the plane of said casting wheel to guide and tension said band and to remove said band from the surface of the casting wheel at the desired end of the mold cavity to route said endless band around one or more of the guide wheels before returning to again contact the casting wheel to form the mold inlet, wherein the band exit/tension wheel, having a wrap angle of about 180°, moves vertically to tension and untension said band.

8. The apparatus of claim 3 in combination with a wheel-band molten metal continuous casting machine wherein the application of a constant tension force to the generally unyielding band maintains an effective sealing engagement of the band even to slightly out of round casting wheels.

9. The apparatus of claim 3 in combination with a wheel-band molten metal continuous casting machine wherein substantially immediate adjustment of the band tension may be effected by adjustment of the fluid pressure.

10. The apparatus of claim 9 wherein the tension applied to the band is maintained within close tolerances, even after band or wheel replacement, by the fluid pressure.

* * * * *